US006554118B2

(12) United States Patent
Lim

(10) Patent No.: US 6,554,118 B2
(45) Date of Patent: Apr. 29, 2003

(54) COIN SUPPLYING APPARATUS OF A COIN SEPARATOR

(75) Inventor: Takwan Lim, Inchon (KR)

(73) Assignee: Royal Sovereign, Inc., Incheon (KR)

( * ) Notice: Subject to any disclaimer, the term of this patent is extended or adjusted under 35 U.S.C. 154(b) by 54 days.

(21) Appl. No.: 09/861,743

(22) Filed: May 21, 2001

(65) Prior Publication Data

US 2002/0170851 A1 Nov. 21, 2002

(51) Int. Cl.[7] ..... G07D 1/00
(52) U.S. Cl. ..... 194/200; 453/57
(58) Field of Search ..... 453/57; 194/200

(56) References Cited

U.S. PATENT DOCUMENTS 5,055,086 A * 10/1991 Raterman et al. ..... 453/10
5,190,495 A * 3/1993 Taxon ..... 221/200
5,232,398 A * 8/1993 Maki ..... 198/397.01
5,695,395 A * 12/1997 Ota et al. ..... 221/203
5,902,178 A 5/1999 Perkitny ..... 453/9
6,165,063 A 12/2000 Perkitny ..... 453/9

* cited by examiner

*Primary Examiner*—Kathy Matecki
*Assistant Examiner*—Sang Kim
(74) *Attorney, Agent, or Firm*—Roberts Abokhair & Mardula, LLC

(57) ABSTRACT

The present invention relates to an apparatus to prevent malfunctions or sorting errors when supplying coins to coin separation holes in a coin separator. The coin separator includes a coin carrier vessel with a coin supply control vessel that can successively supply a small quantity of coins, and an automatic coin release mechanism that causes the above coin carrier vessel to rotate in the reverse direction instantaneously to prevent malfunction and then rotate in the normal direction again resume normal coin separation operations. The automatic coin release mechanism operates in response to any coin that gets caught in the coin carrier vessel during the operation of coin separation that causes the operation to come to a stop.

9 Claims, 4 Drawing Sheets

COIN SUPPLYING APPARATUS OF A COIN SEPARATOR

FIELD OF THE INVENTION

The present invention relates to a coin supply apparatus for a coin separator, wherein a coin supply control vessel having a coin supply section is attached to the coin carrier vessel of the coin separator; a drive means which can rotate in both directions and a gear are attached to a rotation shaft that makes the coin carrier vessel rotate, and a stopper with an elastic body is installed on one side of the gear so that a uniform quantity of coins may be supplied to the coin carrier vessel. When a coin stoppage occurs due to a coin jammed at a coin separation hole, the drive means rotates in the reverse direction to remove the coin. After releasing the jammed coin, the continued reverse rotation of the drive means is ceased, and the coin separation operation is continued as the drive means is rotated in the normal direction.

BACKGROUND INFORMATION

In the fields of commercial dealings, the need to sort and separate many coins quickly and exactly according to size is on the increase.

The existing coin separators have problems in that, during the operation of coin separation, coins accumulate at coin carrier holes in the coin carrier vessel or at separation holes in the coin separation valve because coins are supplied to the coin carrier vessel in large quantities at the same time, whereby a coin may stop at a carrier hole or a separation hole and hinder the rotation of the coin carrier vessel. This can also cause a sorting error to occur, e.g., a small coin drops together with a large coin into a separation hole for large ones.

BRIEF SUMMARY OF THE INVENTION

The purpose of the present invention is to provide a coin supply apparatus for a coin separator, wherein a coin supply control vessel with a coin supply opening and a coin carrier vessel combined with the above coin supply control vessel are made to rotate; a gear is installed near the bottom of the coin carrier vessel; and a stopper that is combined with the teeth of the above gear is installed near the lower-end part of a rotation shaft on which is mounted a drive means that is rotatable in both directions, so that a uniform quantity of coins are supplied to the coin carrier vessel, and if the falling of a coin stops at the coin separation hole, the drive means rotates in the reverse direction to remove the coin, after which the continuous reverse rotation of the drive means is prevented so that the operation of coin separation can be continuously performed as the drive means rotates in its normal direction.

In a preferred embodiment, the coin supply apparatus of a coin separator of the present invention is used with a coin separator having a base housing a drive means. A rotatable shaft is connected to the drive means and a plurality of coin separation holes of varying sizes are located at a radial distance from the shaft. The coin supply apparatus comprises a carrier vessel mounted for rotation on the shaft, a gear, including a plurality of rounded teeth, mounted on the shaft, and a stopper resiliently mounted adjacent the gear and shaped so as to interact with the teeth to allow rotation in an operation direction and limit rotation in the opposite direction. The drive means is auto-reversing so as to reverse rotation direction of said shaft in response to rotational interference.

The rounded teeth have a semicircular profile and the stopper is resiliently mounted adjacent said gear by a spring (operating in a direction perpendicular to said shaft) and the stopper is cut sharp in a quadrangular form to have a tapered side allowing interaction with said teeth to allow rotation in the operation direction and an opposing flat side (perpendicular to the shaft) shaped for allowing interaction with said teeth to limit rotation in the opposite direction.

The carrier vessel includes a plurality of coin carrier holes at a radial distance from the shaft so as to rotate over the coin separation holes. A concave supply control vessel is mounted on the shaft adjacent the carrier vessel and includes a supply opening on a sidewall thereof to supply a fixed amount of coins. The supply control vessel has an outside diameter that corresponds to an inner diameter of the carrier vessel and is supported within and above said carrier vessel. The shaft, carrier vessel, and supply control vessel are mounted about an axis at an acute angle from vertical. A cover with a central input opening for receiving coins is mounted on the supply control vessel. A recess in said base is dimensioned to contain at least the gear, the teeth, the stopper, and the spring.

It is an object of the invention to prevent the jamming of coins in a coin separation apparatus.

It is a further object of the invention to prevent overloads of a drive means for a coin separator.

It is another object of the invention to prevent sorting errors caused by smaller coins dropping with larger coins.

It is another object of the invention to increase the throughput of a coin sorter by allowing continued operations.

It is yet another object of the invention to automatically prevent coin sorter malfunctions.

DETAILED DESCRIPTION OF THE INVENTION

Figure 1:
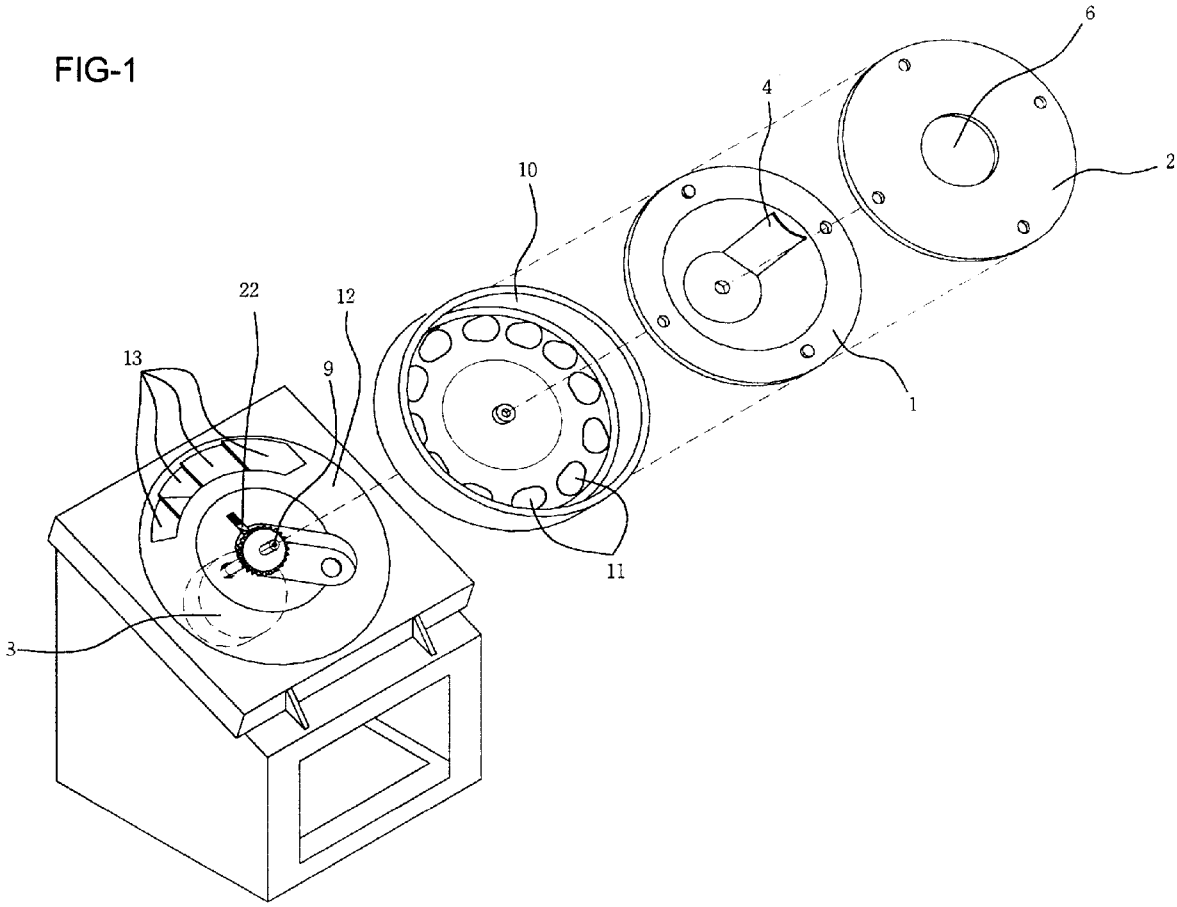
FIG. 1 illustrates a schematic diagram of a coin supply apparatus of the present invention.
Figure 2:
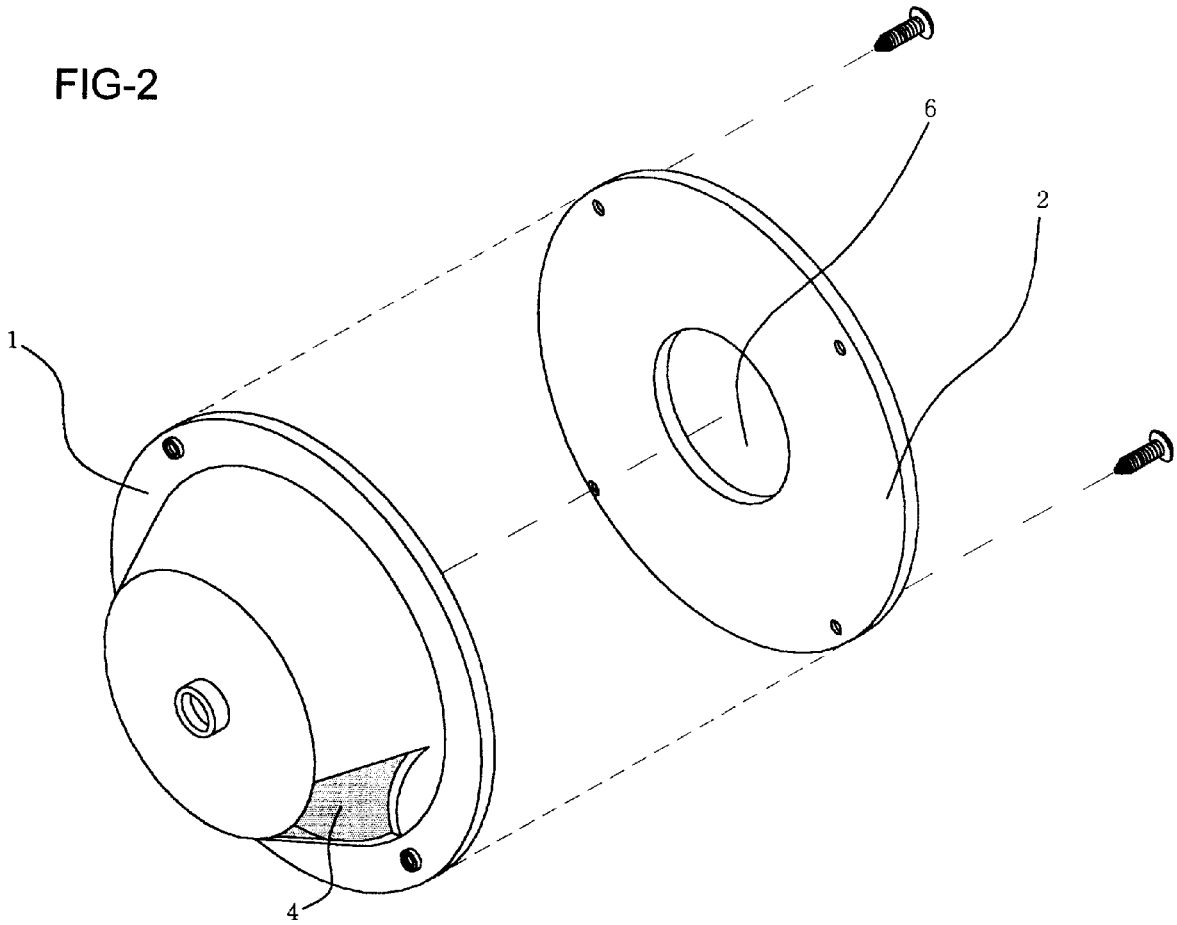
FIG. 2 illustrates a detailed drawing of a coin supply portion of the present invention.
Figure 3:
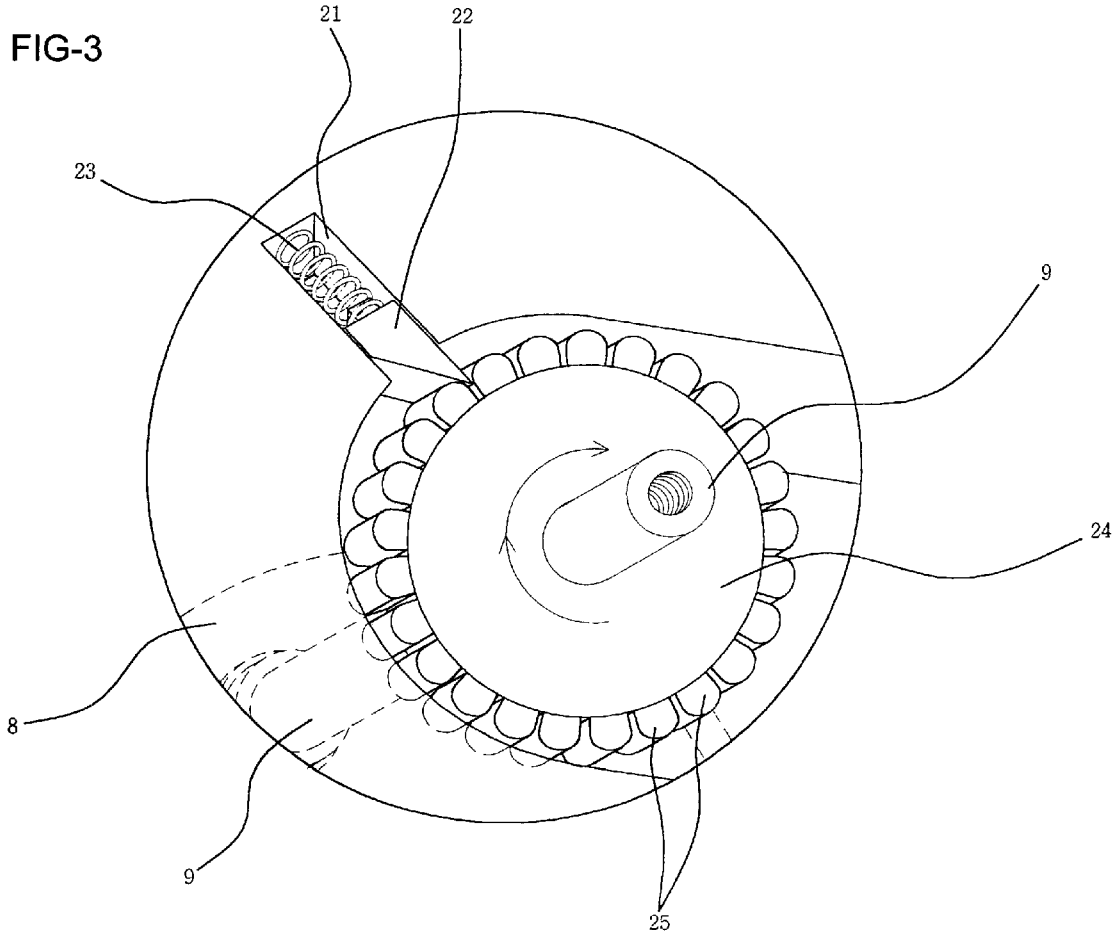
FIG. 3 illustrates a detailed drawing of a drive means of the present invention.
Figure 4:
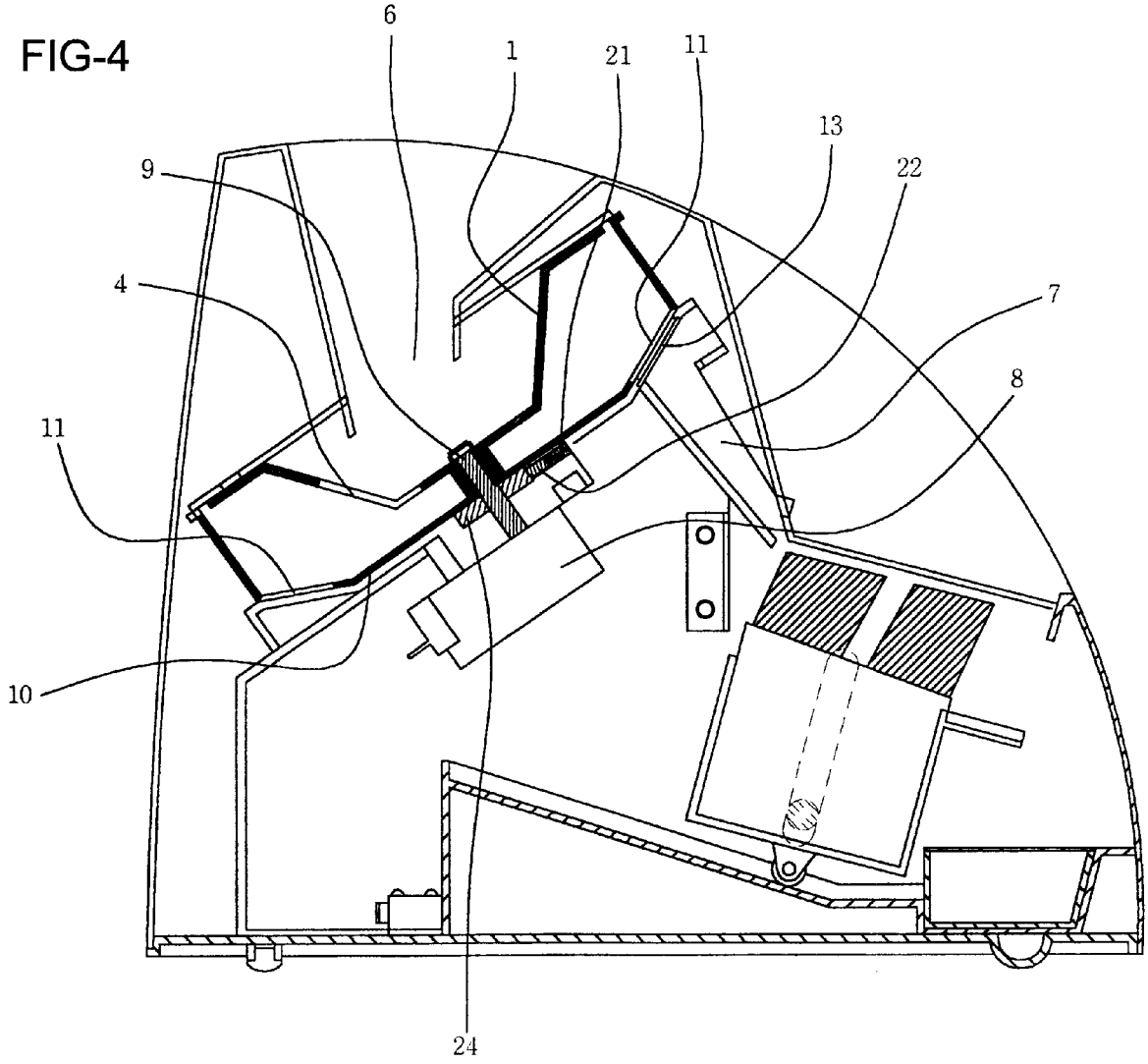
FIG. 4 illustrates a sectional view of a coin separator of the present invention.

As illustrated in the figures, a preferred embodiment of the present invention comprises a supply control vessel 1 that has a concave center and a coin supply opening 4 on its sidewall. It is combined, on its upper part, with a cover 2 that has an input opening 6, as is illustrated in FIGS. 1 and 2. As illustrated in FIG. 1 and in more detail in FIG. 3, a drive means 8, such as an electric motor, is located at a lower end of shaft 9. A gear 24 is attached to an upper part of the rotation shaft 9, to which a carrier vessel 10 and the supply control vessel 1 are combined in turn. Rounded teeth 25 are mounted on gear 24. A stopper 22 is mounted to act on teeth 25 and is safely fit into a housing 21, with a spring 23 being built on its rear part, as illustrated in FIG. 4.

FIG. 1 illustrates the combined structure of the drive means 8 that makes the rotation shaft 9 rotate, the stopper 22 that interferes with the rotating direction of the gear 24, the carrier vessel 10, and the supply control vessel 1. FIG. 2 illustrates the structure and combined state of the supply control vessel 1. FIG. 3 illustrates the structure and function of the stopper 22, and FIG. 4 illustrates in detail the structure of the coin separator based on the present device.

The following is a detailed explanation of the present device, with reference to the drawings and its working example.

The drive means 8 of the present device is so constructed that it rotates in both directions, and its rotation direction changes when the direction of rotation is interfered with. For example, if the gear 24 that is linked to the drive means 8 is stopped by an external pressure while the drive means 8 rotates in its normal direction, the drive means 8 rotates automatically in the reverse direction. Again, if the gear 24 is stopped while the drive means 8 rotates in the reverse direction, the drive means 8 comes to rotate in its normal direction again.

The end portion of the stopper 22 that comes in contact with the teeth 25 of the gear 24 has the characteristic that it prevents the reverse rotation and does not interfere with rotation in he normal direction because it has an incline cut toward the normal direction of rotation, as illustrated in FIG. 3. Additionally, the teeth 25 of the gear 24 are constructed such that they minimize the interference that occurs between the teeth 25 and the stopper 22 during the normal rotation of the gear 24 because their end parts are rounded, as illustrated in FIG. 3.

The supply opening 4 of the supply control vessel 1 is so constructed that it may be placed at the lower part of the carrier vessel 10 when the carrier hole 11 is placed on the same position as the separation hole 13, as illustrated in FIG. 4.

The supply control vessel 1 is assembled and positioned inside of the carrier vessel 10. It has the supply opening 4 on its side wall, and is supported, together with the carrier vessel 10, by the rotation shaft 9 which supports the carrier vessel 10 and penetrates the center of the supply control vessel 1 itself.

The cover 2 that has the input opening 6 is installed on the upper part of the supply control vessel 1 to prevent coins from overflowing the supply control vessel 1.

The rotation shaft 9 is installed in a sloping fashion in the body in order to support the supply control vessel 1 and the carrier vessel 10 at right angles to them, as illustrated in FIG. 4.

As illustrated in FIG. 4, the drive means 8 which supplies the rotary power of the rotation shaft 9 is installed at the lower part of the rotation shaft 9, the gear 24 is installed at its upper part, the stopper 22 which is connected to the teeth 25 of the gear 24 is installed near the gear 24, the spring 23 which supplies elasticity to the stopper 22 is installed at the rear part of the stopper 22, and the stopper 22 and the spring 23 are located inside the housing 21.

With the above construction, the drive means 8 is operated and a coin is inserted into the input opening 6, the carrier vessel 10 rotates together with the supply control vessel 1. Whenever the supply opening 4 of the supply control vessel 1 is placed at the lower half, a fixed quantity of coins drop successively through the supply opening 4, and are supplied to the carrier vessel 10.

The carrier vessel 10 has the carrier holes 11 to carry coins toward the separation holes 13 such that a fixed quantity of coins is supplied from the supply control vessel 1, meets the separation valve 12 which has the separation holes 13, and is rotated by the revolution of the rotation shaft 9.

It is so constructed that coins supplied from the supply control vessel 1 to the carrier vessel 10 are loaded onto the carrier holes 11 according to size, and, while rotating, fall into guides 7 of their own according to size at the separation holes 13 of different size.

In the above procedure of operation, a coin can come to stop at the separation hole 13 such that the carrier vessel 10 ceases to rotate at the moment when the coin in the carrier hole 11 is separated into the separation hole 13 and the speed of the rotation of the carrier vessel 10 do not agree. Generally, if the carrier vessel 10 comes to stop in this manner in the prior art, the coin is removed by hand so as to continue the operation of coin separation. But, as for the present invention, a coin which comes to stop is automatically released without such a handwork.

As noted above, the drive means 8 is rotatable in both directions, and the direction of its rotation is changed only when the direction of rotation is interfered with. That is, if the gear 24 connected with the drive means 8 is stopped by an external pressure while it rotates in the normal direction, the drive means 8 rotates in the reverse direction automatically, and if the gear 24 is stopped while it rotates in the reverse direction, the drive means 8 rotates in the normal direction again. So if a coin comes to stop at the separation hole 13, the drive means 8 rotates in the reverse direction momentarily, a small gap is made instantaneously between the carrier hole 11 and the separation hole 13, and the coin comes to drop.

If the drive means 8, which rotates in the reverse direction like the above, continues its reverse rotation, the operation of coin separation cannot be performed. So the stopper 22 is connected to the teeth 25 of the gear 24 for a quick switch of the rotation of the drive means 8 to the normal direction after its reverse rotation. The gear 24 rotates in the reverse direction by a gap of play between the teeth 25 of the gear 24 and the stopper 22. And then the direction of rotation is switched to the normal direction again to allow the carrier vessel 10 to rotate. With the above procedure, the overload of the drive means 8 can be prevented.

To explain the above with an example of its working, in the coin separator 12 where the separation valve 12 comprises four separation holes 13, from the smallest one 13 to the largest one 13 (increasing in size from left to right), the carrier vessel 10 comprises carrier holes 11 of the same size on each of which only one coin can be loaded. If the drive means 8 is turned on, the drive means 8 is operated, and the carrier vessel 10 and the supply control vessel 1 rotate in the normal direction. If coins of four sizes are inserted into the supply opening 4 of the supply control vessel 1, a small quantity of coins is supplied to the carrier vessel 10 only when the supply opening 4 of the supply control vessel I is in a lower position. That is, a large quantity of coins is prevented from being supplied to the carrier vessel 10 at the same time, and a fixed quantity of coins is allowed to supply continuously.

If a fixed quantity of coins are not supplied uniformly and continuously to the carrier vessel 10 as in the above, but a large quantity of coins are supplied at a time, the separation of coins cannot be normally performed because coins accumulate even at the carrier holes 11 and several coins may drop at the same time.

Coins supplied to the carrier vessel 10 in a fixed quantity in the above manner drop when they pass the separation holes 13, with each being loaded on a carrier hole 11 of the carrier vessel 10. However, a coin may be caught between the carrier hole 11 and the separation hole 13 because of the relation between the falling time of a coin and the revolution speed of the carrier vessel 10, whereby the normal rotation of the carrier vessel 10 is stopped. This causes the carrier vessel 10 to rotate in the reverse direction momentarily because the rotary direction of the drive means 8 is automatically changed by interference, as stated above. If the carrier vessel 10 is rotated in the reverse direction in this manner, a gap occurs between the vessel 10 and the separation valve 12 and the coin is released. Once the jammed coin is released by the reverse rotation, the normal operation of coin separation should be performed with the normal rotation of the carrier vessel 10. So, to switch the reverse rotation of the drive means 8 to the normal rotation, the gear 24 as illustrated in the FIG. 3 is installed on the rotation shaft 9, and the stopper 22 with the sharp tapered portion interacts with the teeth 25 of the gear 24. To the rear part of the stopper is combined the spring 23 which has elasticity in the direction of gear 24 so that the stopper may adhere closely to between the teeth 25, whereby, as illustrated in FIG. 3, the stopper interferes with the rotation of the gear 24 in its reverse rotation, while the rotation of the gear 24 in the normal direction has no difficulty, so that the rotary direction of the drive means 8 may be switched and the carrier vessel 10 may be rotated in the normal direction.

The coin supply apparatus of a coin separator according to the present device can easily perform the separation of coins because the supply control vessel which has a supply opening and to which a cover is combined is combined with the carrier vessel whereby a fixed quantity of coins can be uniformly supplied to the carrier vessel and coins of different kinds can not pass the carrier hole at the same time; and that it can automatically proceed with the operation of coin separation because the drive means which makes the carrier vessel rotate is so constructed that the drive means can rotate in both directions, the gear is mounted on the rotation shaft to which are connected the carrier vessel and the drive means, and the stopper which is linked up with a spring is connected to the teeth of the above gear, whereby, in case that a coin is caught in the carrier vessel during the operation of coin separation, the carrier vessel is automatically made to instantaneously turn in the reverse direction to release the coin, and then is made to rotate in the normal direction again.

I claim:

1. A coin supply apparatus of a coin separator, said coin separator including a base having a drive means, a rotatable shaft connected to said drive means, and a plurality of coin separation holes of varying sizes at a radial distance from said shaft, wherein said coin supply apparatus comprises:

a carrier vessel mounted for rotation on said shaft;

a gear mounted on said shaft, said gear including a plurality of rounded teeth; and a stopper resiliently mounted adjacent said gear and shaped so as to interact with said teeth to allow rotation in an operation direction and limit rotation in a direction opposite of said operation direction, wherein said drive means is auto-reversing so as to reverse a rotation direction of said shaft in response to rotational interference.

2. The coin supply apparatus of a coin separator of claim 1, wherein:

said rounded teeth have a semicircular profile;

said stopper is resiliently mounted adjacent said gear by a spring operating in a direction perpendicular to said shaft; and said stopper has a tapered side allowing interaction with said teeth to allow rotation in said operation direction and an opposing side shaped for allowing interaction with said teeth to limit rotation in said direction opposite of said operation direction.

3. The coin supply apparatus of a coin separator of claim 2, wherein said opposing side is flat and perpendicular to said shaft.

4. The coin supply apparatus of a coin separator of claim 1., wherein said carrier vessel includes a plurality of coin carrier holes at said radial distance from said shaft to interact with said coin separation holes.

5. The coin supply apparatus of a coin separator of claim 4, further comprising:

a concave supply control vessel mounted on said shaft adjacent said carrier vessel, said supply control vessel including a supply opening on a sidewall thereof.

6. The coin supply apparatus of a coin separator of claim 5, wherein said supply control vessel has an outside diameter which corresponds to an inner diameter of said carrier vessel and is supported within and above said carrier vessel.

7. The coin supply apparatus of a coin separator of claim 6, wherein said shaft, carrier vessel, and supply control vessel are mounted about an axis at an acute angle from vertical.

8. The coin supply apparatus of a coin separator of claim 7, further comprising a cover mounted on said supply control vessel, said cover including a central input opening for receiving coins.

9. The coin supply apparatus of a coin separator of claim 4, further comprising a recess in said base, said recess dimensioned to contain at least said gear, said teeth, said stopper, and a spring.

* * * * *

UNITED STATES PATENT AND TRADEMARK OFFICE

CERTIFICATE OF CORRECTION

PATENT NO. : 6,554,118 B2
DATED : April 29, 2003
INVENTOR(S) : Jongsuk Lee

It is certified that error appears in the above-identified patent and that said Letters Patent is hereby corrected as shown below:

Title page,
Item [12], "Lim" should be -- Lee --;
Item [75], "Takwan Lim" should be -- Jongsuk Lee --

Signed and Sealed this

Ninth Day of September, 2003

JAMES E. ROGAN
*Director of the United States Patent and Trademark Office*